US012674624B2

(12) United States Patent
Feng

(10) Patent No.: US 12,674,624 B2
(45) Date of Patent: Jul. 7, 2026

(54) HEAT EXCHANGER

(71) Applicant: ZHEJIANG DUNAN ARTIFICIAL ENVIRONMENT CO., LTD., Shaoxing (CN)

(72) Inventor: Zhongbo Feng, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 222 days.

(21) Appl. No.: 18/571,217

(22) PCT Filed: May 30, 2022

(86) PCT No.: PCT/CN2022/095956
§ 371 (c)(1),
(2) Date: Dec. 16, 2023

(87) PCT Pub. No.: WO2022/262562
PCT Pub. Date: Dec. 22, 2022

(65) Prior Publication Data

US 2024/0280325 A1 Aug. 22, 2024

(30) Foreign Application Priority Data

Jun. 17, 2021 (CN) ..... 202121352666.5

(51) Int. Cl.
*F28F 19/00* (2006.01)
*F28D 7/16* (2006.01)
*F28F 1/04* (2006.01)

(52) U.S. Cl.
CPC ..... *F28D 7/1684* (2013.01); *F28F 1/04* (2013.01); *F28F 19/006* (2013.01)

(58) Field of Classification Search
CPC ..... F28F 1/04; F28F 19/006; F28D 7/1684
See application file for complete search history.

(56) References Cited

U.S. PATENT DOCUMENTS 4,434,843 A * 3/1984 Alford ..... F28D 1/0477 29/890.047

FOREIGN PATENT DOCUMENTS

| | | | |
|---|---|---|---|
| CN | 105403090 | A | 3/2016 |
| CN | 205482509 | U | 8/2016 |
| CN | 208536331 | U | 2/2019 |

(Continued)

OTHER PUBLICATIONS

International Search Report of PCT/CN2022/095956.

*Primary Examiner* — Devon Lane

(57) ABSTRACT

A heat exchanger is provided, including a plurality of fins and a plurality of flat pipes. The plurality of fins are spaced apart and arranged in parallel, a plurality of flat pipe grooves are provided in at least one side of the fins along a width direction of the fins, the plurality of flat pipe grooves are arranged at intervals along a length direction of the fins, and the plurality of flat pipes are correspondingly inserted into the flat pipe grooves. Each of the plurality of fins is provided with a plurality of protruding portions, the plurality of protruding portions are sequentially arranged along the width direction of the current fin to form a corrugated structure, and both ends of the corrugated structure extend towards both sides of the current fin along the length direction of the current fin respectively and pass through both ends of the current fin.

8 Claims, 5 Drawing Sheets

(56) References Cited

FOREIGN PATENT DOCUMENTS

| | | | | | |
|---|---|---|---|---|---|
| CN | 208579665 | U | | 3/2019 | |
| CN | 110425904 | A | * | 11/2019 | ..... F28F 1/325 |
| CN | 211012555 | U | * | 7/2020 | |
| CN | 212390892 | U | * | 1/2021 | |
| CN | 215114092 | U | | 12/2021 | |
| CN | 215413276 | U | | 1/2022 | |
| CN | 215810410 | U | * | 2/2022 | |
| CN | 215984104 | U | | 3/2022 | |
| CN | 216745578 | U | | 6/2022 | |
| CN | 216745668 | U | | 6/2022 | |
| FR | 2563619 | A1 | * | 10/1985 | ..... F28F 19/006 |
| JP | 2011145023 | A | | 7/2011 | |

* cited by examiner

HEAT EXCHANGER

CROSS REFERENCE TO RELATED APPLICATIONS

This application is a U.S. national phase application under 35 U.S.C. § 371 based upon international patent application No. PCT/CN2022/095956, filed on May 30, 2022, which itself claims priority to Chinese patent application No. 202121352666.5, filed on Jun. 17, 2021, titled "HEAT EXCHANGER". The content of the above applications is hereby incorporated by reference.

TECHNICAL FIELD

The present disclosure generally relates to the field of refrigeration, and in particular, to a heat exchanger.

BACKGROUND

Main components of an air conditioning system include a compressor, a condenser, a throttling device, and a heat exchanger. The heat exchanger plays a role of heat exchange with the environment, and the heat exchange is mainly realized by fins and flat pipes on the heat exchanger.

A side surface of the fins of a related heat exchanger is provided with a plurality of flat pipe grooves, and the flat pipes are correspondingly inserted into the flat pipe grooves. When the heat exchanger is used as an evaporator, discharge of condensate water between the fins is difficult, and poor drainage would lead to poor performance of the heat exchanger, thereby lowering heat exchange efficiency.

SUMMARY

According to various embodiments of the present disclosure, a heat exchanger is provided.

The heat exchanger includes a plurality of fins and a plurality of flat pipes, the plurality of fins are spaced apart from each other and arranged in parallel, a plurality of flat pipe grooves are provided in at least one side of the plurality of fins along a width direction of the plurality of fins, the plurality of flat pipe grooves are arranged at intervals along a length direction of the plurality of fins, and the plurality of flat pipes are correspondingly inserted into the plurality of flat pipe grooves. Each of the plurality of fins is provided with a plurality of protruding portions, the plurality of protruding portions are sequentially arranged along the width direction of the plurality of fins to form a corrugated structure, and both ends of the corrugated structure extend towards both sides of the plurality of fins along the length direction of the plurality of fin respectively and pass through both ends of the plurality of fins.

In an embodiment, an end of the plurality of the flat pipe grooves passes through a side of the plurality of the fins to form notches, a distance between a side of one of the plurality of flat pipes proximal to a corresponding notch and the corresponding notch along the width direction of the plurality of fins is denoted as P, a width of the plurality of flat pipes is denoted as W, and the distance P between the side of one of the plurality of flat pipes proximal to the corresponding notch and the corresponding notch along the width direction of the plurality of fins and the width W of the plurality of flat pipes satisfy the following relational formula: $0<P\leq W$.

In an embodiment, an end of the plurality of the flat pipe grooves passes through a side of the plurality of the fins to form notches, a distance between a side of one of the plurality of flat pipes proximal to a corresponding notch and the corresponding notch along the width direction of the plurality of fins is denoted as P, and the distance P between the side of one of the plurality of flat pipes proximal to the corresponding notch and the corresponding notch along the width direction of the plurality of fins satisfies the following relational formula: $0.1\ \text{mm}<P\leq 10\ \text{mm}$.

In an embodiment, the plurality of fins are provided with a first side and a second side along the width direction of the plurality of fins, both the first side and the second side of the plurality of fins are provided with the plurality of flat pipe grooves, a distance between a center plane of one of the plurality of flat pipe grooves located on the first side of the plurality of fins along the length direction of the plurality of fins and a center plane of one of the plurality of flat pipe grooves located on the second side of the plurality of fins along the length direction of the plurality of fins is denoted as T, a distance between center planes of adjacent two of the plurality of flat pipe grooves located on the same side of the plurality of fins along the width direction of the plurality of fins is denoted as L, and the distance T and the distance L satisfy the following relational formula: $0.5<T/L\leq 1.5$.

In an embodiment, the plurality of flat pipe grooves located on the first side of the plurality of fins are provided in one-to-one correspondence with the plurality of flat pipe grooves located on the second side of the plurality of fins.

In an embodiment, the plurality of flat pipe grooves located on the first side of the plurality of fins are staggered with the plurality of flat pipe grooves located on the second side of the plurality of fins.

In an embodiment, a distance between center planes of adjacent two of the plurality of flat pipe grooves along the width direction of the plurality of fins is denoted as S, the adjacent two of the plurality of flat pipe grooves are staggered, and the distance S and the distance L satisfy the following relational formula: $\frac{1}{3}\leq S/L\leq\frac{2}{3}$.

In an embodiment, the plurality of fins are provided with a flap structure, and the flap structure is disposed proximal to the plurality of flat pipe grooves and abuts against a side wall of the plurality of flat pipes.

In an embodiment, a height of the flap structure protruding the plurality of fins is denoted as D, and the height D of the flap structure is less than spacing between adjacent two of the plurality of fins.

In an embodiment, the heat exchanger further includes a side plate and an elbow, a structure of the side plate is matched with a structure of the plurality of fins, the side plate is mounted on at least one end of the plurality of flat pipes, the plurality of flat pipes are inserted into the side plate, and the elbow is connected between adjacent two of the plurality of flat pipes.

Details of one or more embodiments of the present disclosure are set forth in the following accompanying drawings and description. Other features, objects, and advantages of the present disclosure will become apparent from the specification, the accompanying drawings, and the claims.

BRIEF DESCRIPTION OF THE DRAWINGS

Reference may be made to one or more of the accompanying drawings for a purpose of better describing and illustrating the embodiments and/or examples of those applications disclosed herein. Additional details or examples used to describe the accompanying drawings should not be considered a limitation on the scope of any of the disclosed applications, the embodiments and/or examples presently described, and the best mode of these applications as presently understood.

In the figures, 100 represents a heat exchanger, 10 represents a fin, 11 represents a flat pipe groove, 111 represents a notch, 112 represents a flap structure, 12 represents a first side, 13 represents a second side, 20 represents a flat pipe, 21 represents a protruding portion, 22 represents a corrugated structure, 30 represents a side plate, 40 represents an elbow.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without making creative labor are the scope of the present disclosure.

It should be noted that when an assembly is considered to be "arranged on" another assembly, it can be directly arranged on another assembly, or there can be a centered assembly. When an assembly is considered to be "disposed on" another assembly, it can be directly disposed on another assembly, or there can be a centered assembly at the same time. When an assembly is considered to be "fixed to" another assembly, it can be directly fixed to another assembly, or there can be a centered assembly at the same time.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "and/or" as used herein includes any and all combinations of one or more of the associated listed items.

Figure 1:
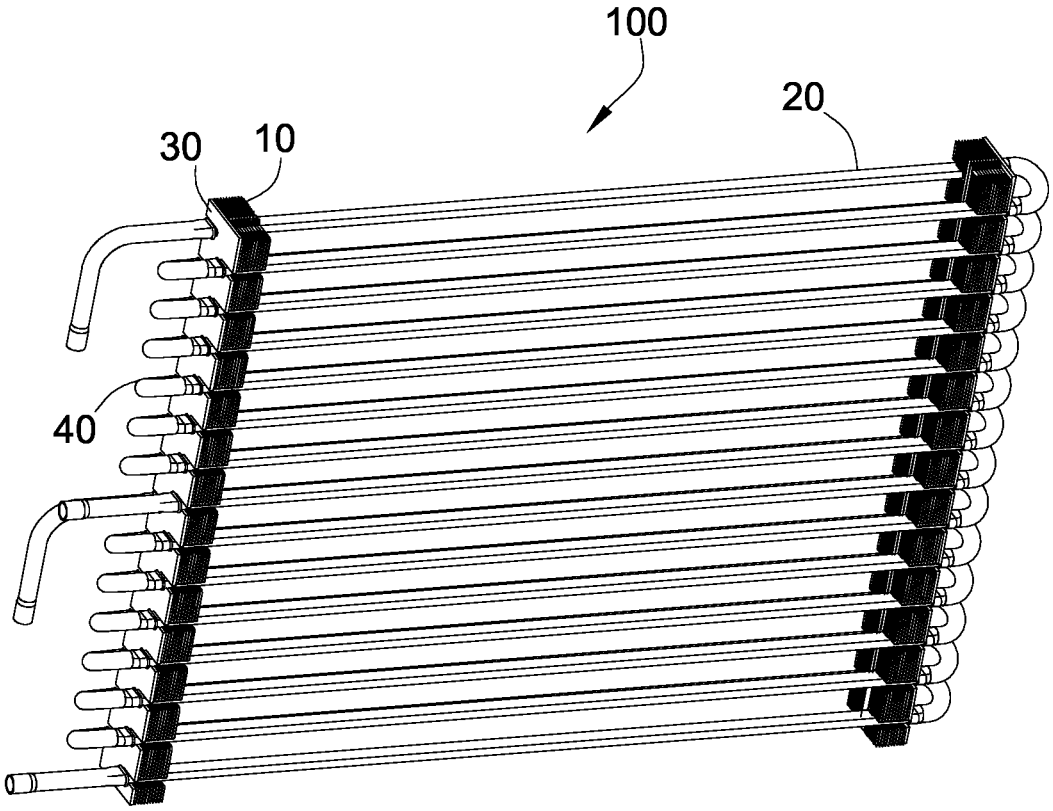
FIG. 1 is a schematic diagram of a heat exchanger according to some embodiments.

Referring to FIG. 1, the present disclosure provides a heat exchanger 100, which is configured for heat exchange with environment.

Main components of an air conditioning system include a compressor, a condenser, a throttling device, and a heat exchanger. The heat exchanger plays a role of heat exchange with environment, and the heat exchange is mainly realized by fins and flat pipes on the heat exchanger. A related heat exchanger includes a fin and multiple flat pipes, a side surface of the fin is provided with a plurality of flat pipe grooves, and the flat pipes are correspondingly inserted into the flat pipe grooves. When the heat exchanger is used as an evaporator, condensate water between the fins is difficult to be discharged, and poor drainage would lead to weak performance of the heat exchanger, thereby lowering heat exchange efficiency.

Referring to FIG. 1 again, the heat exchanger provided in the present disclosure includes a plurality of fins 10 and a plurality of flat pipes 20, the plurality of fins 10 are spaced apart from each other and arranged in parallel, a plurality of flat pipe grooves 11 are provided in at least one side of the plurality of fins 10 along a width direction of the plurality of fins 10, the plurality of flat pipe grooves 11 are arranged at intervals along a length direction of the plurality of fins 10, and the plurality of flat pipes 20 are correspondingly inserted into the plurality of flat pipe grooves 11. In this way, it can improve heat exchange efficiency between the plurality of flat pipes 20 and the plurality of fins 10, thereby improving heat exchange performance of the heat exchanger 100.

Figure 3:
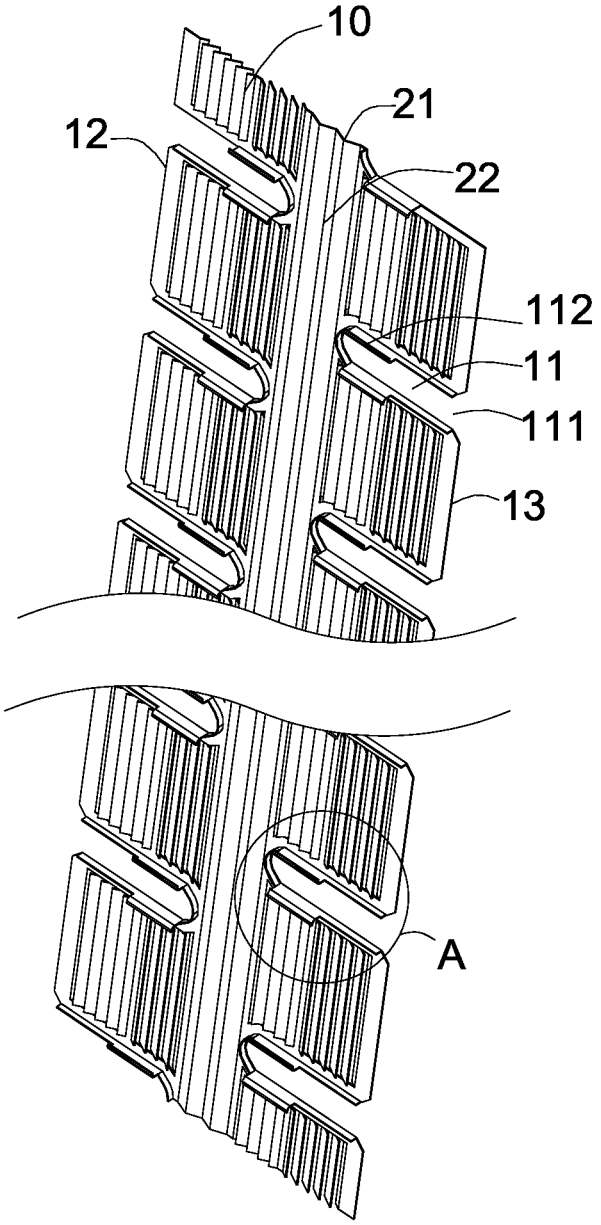
FIG. 3 is a partial schematic diagram of a fin according to some embodiments.

Furthermore, referring to FIG. 3, each of the plurality of fins 10 is provided with a plurality of protruding portions 21, the plurality of protruding portions 21 are sequentially arranged along the width direction of the plurality of fins 10 to form a corrugated structure 22, and both ends of the corrugated structure 22 extend towards both sides of the plurality of fins 10 along the length direction of the plurality of fins 10 respectively and pass through both ends of the plurality of fins 10. The corrugated structure 22 is defined by the plurality of protruding portions 21, which facilitates discharging condensate water, so that more meltwater may flow directly down the corrugated structure 22 when defrosting, and the heat exchanger 100 has a smoother drainage, so as to improve the performance of the heat exchanger 100 and improve the heat exchanger efficiency of the heat exchanger 100. Moreover, the corrugated structure 22 may enhance stiffness of the plurality of fins 10, so as to improve structural robustness of the heat exchanger 100.

In an embodiment, an end of the plurality of the flat pipe grooves 11 may pass through a side of the plurality of the fins 10 to form notches 111, a distance between a side of one of the plurality of flat pipes 20 proximal to a corresponding notch 111 and the corresponding notch 111 along the width direction of the plurality of fins may be denoted as P, a width of the plurality of flat pipes 20 may be denoted as W, and the distance P between the side of one of the plurality of flat pipes 20 proximal to the corresponding notch 111 and the corresponding notch 111 along the width direction of the plurality of fins and the width W of the plurality of flat pipes 20 may satisfy the following relational formula: $0<P\leq W$. In this way, it may balance the heat exchange performance and frosting performance of the heat exchanger 100, thereby improving the heat exchange efficiency of the heat exchanger 100.

Figure 5:
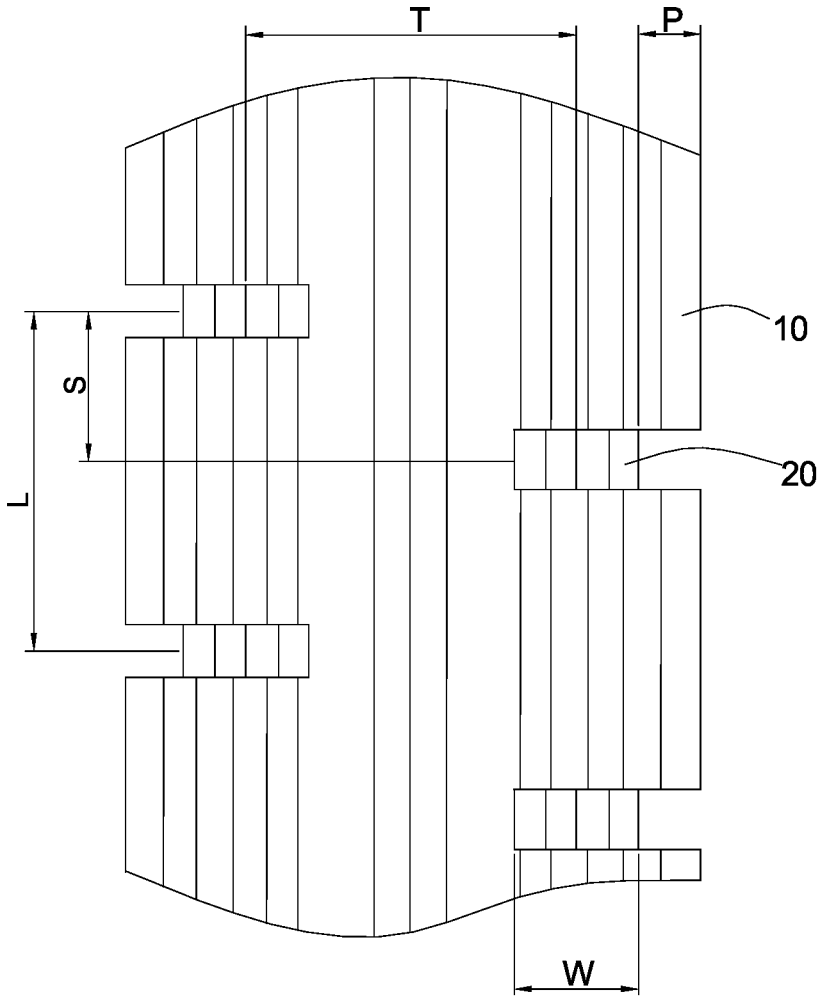
FIG. 5 is a partial schematic diagram of a fin and flat pipe according to some embodiments.

Referring to FIG. 3 and FIG. 5, in another embodiment, an end of the plurality of the flat pipe grooves 11 may pass through a side of the plurality of the fins 10 to form notches 111, a distance between a side of one of the plurality of flat pipes 20 proximal to a corresponding notch 111 and the corresponding notch 111 along the width direction of the plurality of fins may be denoted as P, and the distance P between the side of one of the plurality of flat pipes 20 proximal to the corresponding notch 111 and the corresponding notch 111 along the width direction of the plurality of fins may satisfy the following relational formula: $0.1\ mm<P<10\ mm$. In this way, it may balance the heat exchange performance and frosting performance of the heat exchanger 100. When the distance P satisfies $P\leq 0.1$ mm, due to a relatively low temperature of the plurality of flat pipes 20, a contact area of the plurality of fins 10 and the plurality of flat pipes 20 may be large at this moment, and a temperature of an end of the plurality of fins 10 in contact with the plurality of flat pipes 20 would be relatively low, resulting in a fast frosting speed, i.e., a gap between the plurality of fins 10 and the plurality of flat pipes 20 may be frosted, which is prone to cause a frost plugging situation.

When the distance P satisfies P>10 mm, the contact area of the plurality of fins 10 and the plurality of flat pipes 20 may be too small, resulting in a low heat exchange efficiency and a poor heat exchange efficiency of the plurality of fins 10, thereby reducing cost-effectiveness of the heat exchanger 100. In other embodiments, the distance P may be adjusted according to actual requirements, such as the distance P may be 0.5 mm, 1 mm, 2 mm, 4 mm, 6 mm, or 8 mm.

Furthermore, the plurality of fins 10 may be provided with a first side 12 and a second side 13 along the width direction of the plurality of fins 10, both the first side 12 and the second side 13 of the plurality of fins 10 may be provided with the plurality of flat pipe grooves 11, a distance between a center plane of one of the plurality of flat pipe grooves 11 located on the first side 12 of the plurality of fins 10 along the length direction of the plurality of fins 10 and a center plane of one of the plurality of flat pipe grooves 11 located on the second side 13 of the plurality of fins 10 along the length direction of the plurality of fins 10 may be denoted as T, a distance between center planes of adjacent two pf the plurality of flat pipe grooves 11 located on the same side of the plurality of fins 10 along the width direction of the plurality of fins 10 may be denoted as L, and the distance T and the distance L may satisfy the following relational formula: $0.5<T/L\leq 1.5$. In other embodiments, T/L may be adjusted according to actual requirements, such as T/L may be 0.8, 1, 1.2, or 1.4.

The present disclosure is able to further balance the heat exchange performance and frosting performance of the heat exchanger 100 and enhance heat exchange effect of the heat exchanger 100 by defining relative sizes of the distance T and the distance L. When the distance T and the distance L satisfy $T/L<0.5$, arrangement among the plurality of flat pipes 20 is structurally compact, resulting in a reduction in a heat exchange area between the plurality of fins 10 and the plurality of flat pipes 20, which reduces efficiency of the plurality of fins 10 and results in a poor heat exchange effect. When the distance T and the distance L satisfy $T/L>1.5$, it may lead to an increase in wind resistance, and the plurality of fins 10 and the plurality of flat pipes 20 may have a large contact area, and the temperature of the end of the plurality of fins 10 in contact with the plurality of flat pipes 20 may be low, resulting in the fast frosting speed, which is prone to cause the frost plugging situation. Meanwhile, $T/L>1.5$ may increases material amount of the plurality of fins 10, which may increase the cost.

In an embodiment, the plurality of flat pipe grooves 11 located on the first side 12 of the plurality of fins 10 may be provided in one-to-one correspondence with the plurality of flat pipe grooves 11 located on the second side 13 of the plurality of fins 10. In this way, it may facilitate inserting the plurality of flat pipes 20, improving the heat exchange efficiency of the plurality of fins 10, and improving the cost-effectiveness of the heat exchanger 100.

Referring to FIG. 3, in the present disclosure, the plurality of flat pipe grooves 11 located on the first side 12 of the plurality of fins 10 may be staggered with the plurality of flat pipe grooves 11 located on the second side 13 of the plurality of fins 10, which may facilitate inserting the plurality of flat pipes 20. The heat exchange efficiency between the plurality of flat pipes 20 which are staggered and the plurality of fins 10 may be better, which may improve the heat exchange efficiency of the plurality of fins 10, thereby improving the cost-effectiveness of the heat exchanger 100.

Furthermore, referring to FIG. 5, a distance between center planes of adjacent two of the plurality of flat pipe grooves 11 along the width direction of the plurality of fins 10 may be denoted as S, the adjacent two of the plurality of flat pipe grooves are staggered, and the distance S and the distance L may satisfy the following relational formula: $\frac{1}{3}\leq S/L\leq\frac{2}{3}$. In this way, the heat exchange efficiency of the plurality of fins 10 may be improved and the heat exchange effect may be enhanced by rationally arranging the plurality of flat pipes 20. When S/L is too small, it may lead to an increase in wind resistance, affecting the heat exchange efficiency. When S/L is too large, it may lead to a material waste of the plurality of fins 10. In other embodiments, S/L may be adjusted according to actual requirements, such as S/L may be $\frac{5}{12}$, $\frac{13}{24}$, or $\frac{7}{12}$.

Alternatively, the distance between center planes of adjacent two of the plurality of flat pipe grooves 11 along the width direction of the plurality of fins 10 may be denoted as S, the adjacent two of the plurality of flat pipe grooves are staggered, and the distance S and the distance L may satisfy the following relational formula: $S/L=\frac{1}{2}$. In this way, the heat exchange area between the plurality of fins 10 and each of the plurality of flat pipes 20 is roughly equal, so as to improve the heat exchange efficiency of the plurality of fins 10 and enhance the heat exchange performance of the heat exchanger 100.

Referring to FIG. 3, the plurality of fins 10 may be provided with a flap structure 112, and the flap structure 112 may be disposed proximal to the plurality of flat pipe grooves 11 and abut against a side wall of the plurality of flat pipes 20. The flap structure 112 may enhance welding strength of the plurality of flat pipes 20.

Figure 4:
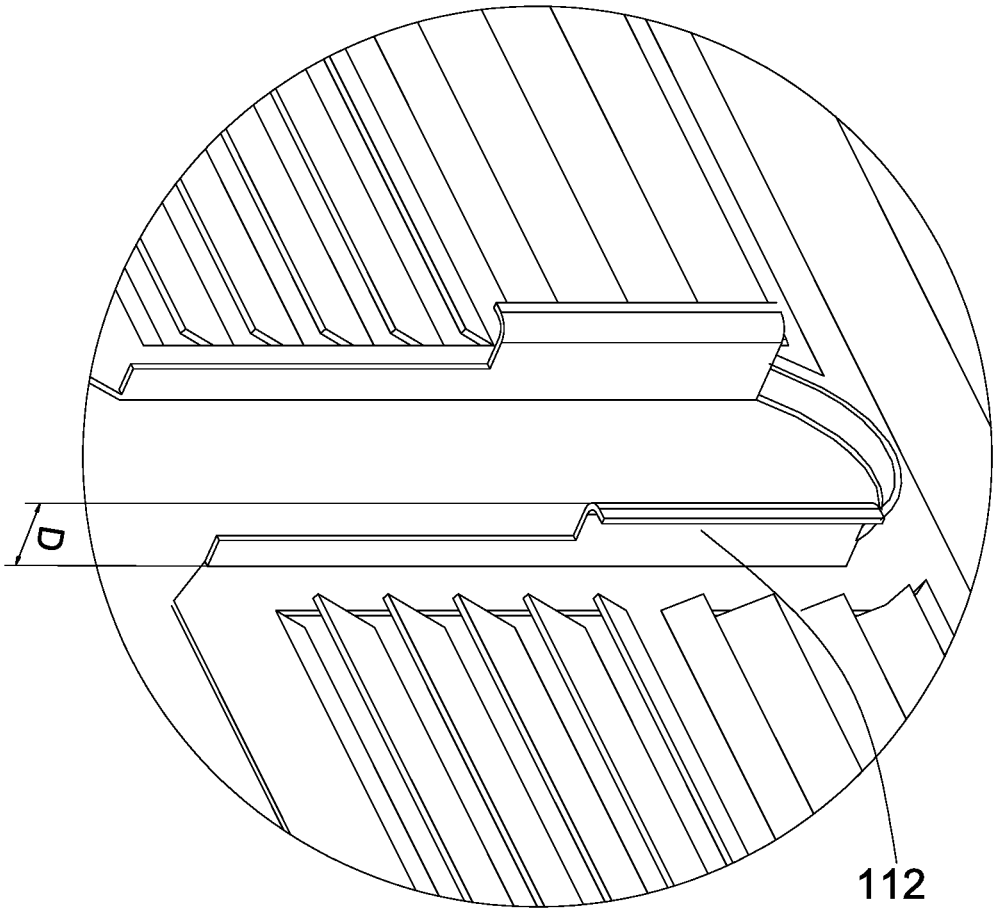
FIG. 4 is a partially enlarged diagram of A of FIG. 3.

Furthermore, referring to FIG. 4, a height of the flap structure 112 protruding the plurality of fins 10 may be denoted as D, and the height D of the flap structure 112 may be less than spacing between adjacent two of the plurality of fins 10.

Specifically, the height D of the flap structure 112 protruding the plurality of fins 10 may be less than $\frac{2}{3}$ of the spacing between adjacent two of the plurality of fins 10. The spacing between adjacent two of the plurality of fins 10 may be increased by decreasing the height D of the flap structure 112 protruding the plurality of fins 10, thereby improving the heat exchange efficiency of the plurality of fins 10 and the heat exchange efficiency of the heat exchanger 100. In other embodiments, the height D may be adjusted according to actual requirements, such as the height D of the flap structure 112 protruding the plurality of fins 10 may be may be $\frac{1}{2}$, $\frac{1}{3}$, or $\frac{1}{6}$ of the spacing between adjacent two of the plurality of fins 10.

Figure 2:
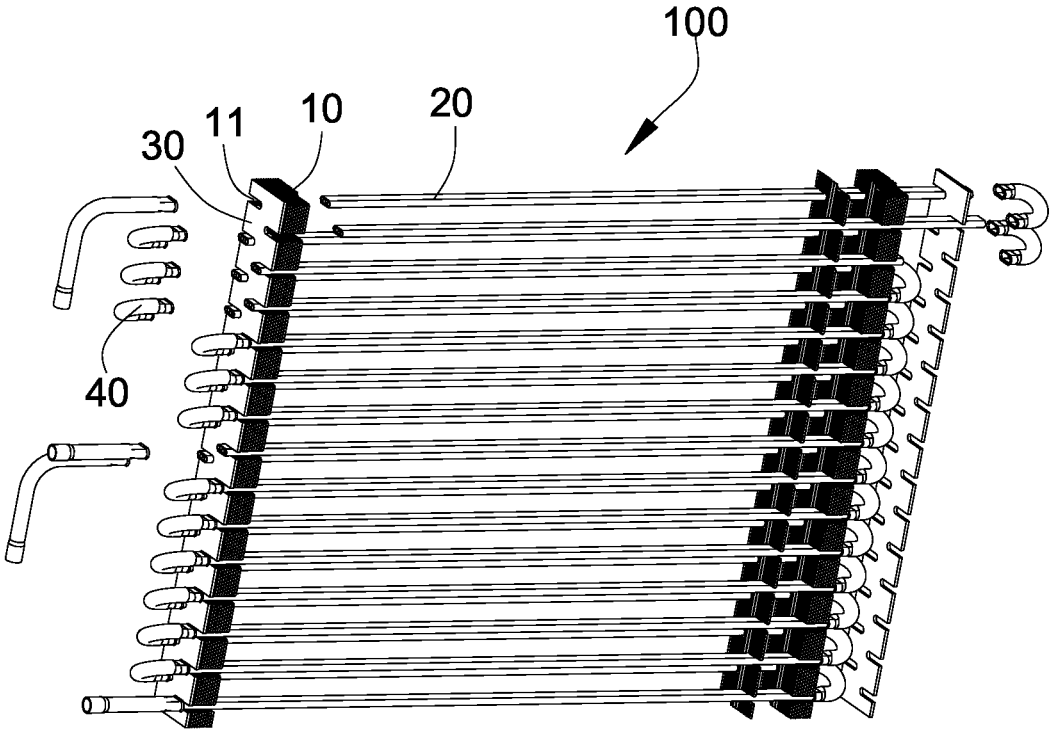
FIG. 2 is an exploded diagram of a heat exchanger according to some embodiments.

Referring to FIG. 2, the heat exchanger 100 may further include a side plate 30 and an elbow 40, a structure of the side plate 30 may be matched with a structure of the plurality of fins 10, the side plate 30 may be mounted on at least one end of the plurality of flat pipes 20, the plurality of flat pipes 20 may be inserted into the plurality of fins 10 and the side plate 30, and the elbow 40 may be connected between adjacent two of the plurality of flat pipes 20. The present disclosure may adopt the elbow 40 for connection, which may allow a flow path layout more flexible. In this way, structural stability of the heat exchanger 100 may be strengthened, thereby improving the performance of the heat exchanger 100.

In addition, it should be noted that the use of terms such as "first" and "second" to define parts is only for the purpose of facilitating distinction between corresponding parts, unless otherwise stated, the above words have no special meaning, and therefore cannot be construed as limiting the scope of protection of the present disclosure.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

What is claimed is:

1. A heat exchanger, comprising a plurality of fins and a plurality of flat pipes, the plurality of fins being spaced apart from each other and arranged in parallel, a plurality of flat pipe grooves being provided in at least one side of the plurality of fins along a width direction of the plurality of fins, the plurality of flat pipe grooves being arranged at intervals along a length direction of the plurality of fins, and the plurality of flat pipes being correspondingly inserted into the plurality of flat pipe grooves;

wherein each of the plurality of fins is provided with a plurality of protruding portions, the plurality of protruding portions are sequentially arranged along the width direction of the plurality of fins to form a corrugated structure, and both ends of the corrugated structure extend towards both sides of the plurality of fins along the length direction of the plurality of fin respectively and pass through both ends of the plurality of fins;

an end of the plurality of the flat pipe grooves passes through a side of the plurality of the fins to form notches, a distance between a side of one of the plurality of flat pipes proximal to a corresponding notch and the corresponding notch along the width direction of the plurality of fins is denoted as P, and the distance P between the side of one of the plurality of flat pipes proximal to the corresponding notch and the corresponding notch along the width direction of the plurality of fins satisfies the following relational formula: $0.1\ \text{mm}<P\leq 10\ \text{mm}$; and the plurality of fins are provided with a first side and a second side along the width direction of the plurality of fins, both the first side and the second side of the plurality of fins are provided with the plurality of flat pipe grooves, a distance between a center plane of one of the plurality of flat pipe grooves located on the first side of the plurality of fins along the length direction of the plurality of fins and a center plane of one of the plurality of flat pipe grooves located on the second side of the plurality of fins along the length direction of the plurality of fins is denoted as T, a distance between center planes of adjacent two of the plurality of flat pipe grooves located on the same side of the plurality of fins along the width direction of the plurality of fins is denoted as L, and the distance T and the distance L satisfy the following relational formula: $0.8\leq T/L\leq 1.5$.

2. The heat exchanger of claim 1, wherein an end of the plurality of the flat pipe grooves passes through a side of the plurality of the fins to form notches, a distance between a side of one of the plurality of flat pipes proximal to a corresponding notch and the corresponding notch along the width direction of the plurality of fins is denoted as P, a width of the plurality of flat pipes is denoted as W, and the distance P between the side of one of the plurality of flat pipes proximal to the corresponding notch and the corresponding notch along the width direction of the plurality of fins and the width W of the plurality of flat pipes satisfy the following relational formula: $0<P\leq W$.

3. The heat exchanger of claim 1, wherein the plurality of flat pipe grooves located on the first side of the plurality of fins are provided in one-to-one correspondence with the plurality of flat pipe grooves located on the second side of the plurality of fins.

4. The heat exchanger of claim 1, wherein the plurality of flat pipe grooves located on the first side of the plurality of fins are staggered with the plurality of flat pipe grooves located on the second side of the plurality of fins.

5. The heat exchanger of claim 4, wherein a distance between center planes of adjacent two of the plurality of flat pipe grooves along the width direction of the plurality of fins is denoted as S, the adjacent two of the plurality of flat pipe grooves are staggered, and the distance S and the distance L satisfy the following relational formula: $\frac{1}{3}\leq S/L\leq\frac{2}{3}$.

6. The heat exchanger of claim 1, wherein the plurality of fins are provided with a flap structure, and the flap structure is disposed proximal to the plurality of flat pipe grooves and abuts against a side wall of the plurality of flat pipes.

7. The heat exchanger of claim 6, wherein a height of the flap structure protruding the plurality of fins is denoted as D, and the height D of the flap structure is less than spacing between adjacent two of the plurality of fins.

8. The heat exchanger of claim 1, further comprising a side plate and an elbow, wherein a structure of the side plate is matched with a structure of the plurality of fins, the side plate is mounted on at least one end of the plurality of flat pipes, the plurality of flat pipes are inserted into the side plate, and the elbow is connected between adjacent two of the plurality of flat pipes.

* * * * *